United States Patent [19]

Hickman

[11] 4,140,309

[45] Feb. 20, 1979

[54] WORKBENCHES

[75] Inventor: Ronald P. Hickman, Waltham Abbey, England

[73] Assignee: Inventec International Limited, Point Robert, Channel Islands

[21] Appl. No.: 846,575

[22] Filed: Oct. 28, 1977

Related U.S. Application Data

[60] Division of Ser. No. 642,743, Dec. 22, 1975, Pat. No. 4,076,229, which is a continuation of Ser. No. 495,265, Aug. 7, 1974, abandoned, which is a division of Ser. No. 177,123, Sep. 1, 1971, Pat. No. 3,841,619, which is a division of Ser. No. 803,600, Mar. 3, 1969, Pat. No. 3,615,807.

[30] Foreign Application Priority Data

Mar. 4, 1968 [GB] United Kingdom ..... 10484/68

[51] Int. Cl.[2] ..... B25B 1/10

[52] U.S. Cl. ..... 269/139; 269/219; 269/244; 269/321 CF

[58] Field of Search ..... 269/219–222, 269/139, 244, 258, 321 CF; 144/286 R, 286 A, 287, 288 R, 288 C

[56] References Cited

U.S. PATENT DOCUMENTS

| | | | |
|---|---|---|---|
| 101,126 | 3/1870 | Hayes | 269/113 |
| 300,178 | 6/1884 | Williams | 269/289 |
| 732,585 | 6/1903 | Reinhardt | 108/19 |
| 968,038 | 8/1910 | Everest | 269/220 |
| 982,093 | 1/1911 | Russ | 108/121 |
| 985,857 | 3/1911 | Thomas | 269/222 |
| 1,246,438 | 11/1917 | Lagerback | 269/221 |
| 1,328,492 | 1/1920 | Carman | 144/12 |
| 1,403,958 | 1/1922 | Holman | 269/220 |
| 1,652,802 | 12/1927 | Smith | 269/165 |
| 1,716,718 | 6/1929 | Castagna | 269/221 |
| 2,233,760 | 3/1941 | Wertz | 269/221 |
| 2,541,508 | 2/1951 | Fleming | 144/286 |
| 2,629,924 | 3/1953 | Kauper | 269/222 |
| 3,060,917 | 10/1962 | Dickey | 125/35 |
| 3,615,087 | 10/1971 | Hickman | 269/139 |
| 3,841,619 | 10/1974 | Hickman | 269/220 |
| 4,076,229 | 2/1978 | Hickman | 269/139 |

FOREIGN PATENT DOCUMENTS

| | | |
|---|---|---|
| 159875 | 8/1952 | Australia. |
| 1111118 | 7/1961 | Fed. Rep. of Germany. |
| 1025120 | 4/1966 | United Kingdom. |

OTHER PUBLICATIONS

The Practical Wood Worker, Bernard E. Jones, p. 497, Figures 71 and 72.

*Primary Examiner*—Robert C. Watson
*Attorney, Agent, or Firm*—Brumbaugh, Graves, Donohue & Raymond

[57] ABSTRACT

A workbench of saw-horse height has its top formed by a pair of longitudinally extending top members which form a working surface and which are carried by transverse supports. One of the top members is fixed with respect to the supports but the other is horizontally movable towards and away from the fixed top member to form a vice between the opposed vertical faces of the top members. Adjacent each end the top members are interconnected by screw threaded rods which are restrained against axial movement at their ends adjacent the fixed top members but which are received in nuts connected to the movable top member. The connection of the nut to the movable top member allows independent operation of the screw threaded rods to permit the gap between the vertical faces to be greater at one end than at the other.

8 Claims, 7 Drawing Figures

WORKBENCHES

This is a division, of application Ser. No. 642,743, now U.S. Pat. No. 4,076,229 filed Dec. 22, 1975, which is a continuation of application Ser. No. 495,265, filed Aug. 7, 1974, now abandoned which is a division of application Ser. No. 177,123, filed Sept. 1, 1971 now U.S. Pat. No. 3,891,619, which is a division of application Ser. No. 803,600, filed Mar. 3, 1969 now U.S. Pat. No. 3,615,887.

This invention relates to workbenches and is concerned wih the provision of an arrangement wherein the bench has a vice incorporated as part of its basic structure. With many applications it is desirable to be able to clamp up an elongated timber or other workpiece but prior proposals have not enabled this to be done in a satisfactory manner. Specifically it has not been possible readily to clamp up a tapered workpiece.

According to one aspect of the present invention a workbench includes a supporting structure bearing a pair of top members having upper surfaces lying in substantially the same plane, e.g. to form a working surface, at least one of the top members being movable with respect to the other to cause opposed substantially vertical faces thereof to be moved relatively towards and away from one another, said movement being caused by actuation of one or both of a pair of spaced clamping devices which are capable of independent operation to permit the gap between the vertical faces to be greater at one end than at the other.

According to one convenient arrangement the pair of top members between them afford the complete working surface of the bench. Thus the arrangement may be such that one top member is securely fixed to the supporting structure whilst the other top member is mounted for horizontal movement towards and away from the fixed top member. In an alternative construction a third top member may be included which is disposed on the side of the movable top member remote from the first, the third top member being rigidly secured to the supporting structure.

The supporting structure conveniently incorporates a pair of horizontal transverse supports to which one top member is securely fixed, the transverse supports affording horizontal slideways upon which the movable top member can bear during its movement. The transverse supports may take various forms but conveniently each may comprise an inverted channel member within which screw threaded devices are mounted, the movable top member being secured to slider members located by the channel members for substantially longitudinal movement with respect thereto. For example in this case the screw threaded devices may comprise screw threaded rods extending substantially at right angles to the vertical face of the stationary top member, and co-operating with screw threaded bores of associated slider members.

In order to allow the gap between the vertical faces to be greater at one end than the other the top member is preferably secured to the slider members by securing means which permit relative rotation about a vertical axis. However, where the top supports are channel members, the slider members may be located for longitudinal movement with respect to the channel members, e.g. by co-operating projections and slots provided respectively thereon, but preferably the slider members are located such that they can move laterally slightly with respect to the channels. Thus the slider member may have a projection which is laterally of a width which is less than the width of a locating slot provided by the channel member. This will permit the arcuate movement of an end (or both ends) of the movable top member. It will be appreciated that the same effect can be obtained in other ways, e.g. by relative movement between the associated slider member and means by which it is secured to the top member. Alternatively the relative movement could occur between the said securing means and the top member itself. A further possibility of allowing for the arcuate movement would be to permit the screw thread devices to move translationally at their ends opposite to the ends which co-operate with the slider members.

The supporting structure may include a base structure interconnected with the top members by supporting members which are capable of movement between a collapsed position in which the top members are in closed juxtaposition to the base structure and a working position in which the top members are spaced from and supported by the base structure.

The screw threaded rods are conveniently actuated by crank handles which each may be formed in two hinged sections to allow the crank to be folded for storage.

The invention may be carried into practice in a number of ways but two specific embodiments will now be described by way of example with reference to the accompanying drawings in which.

Figure 1:
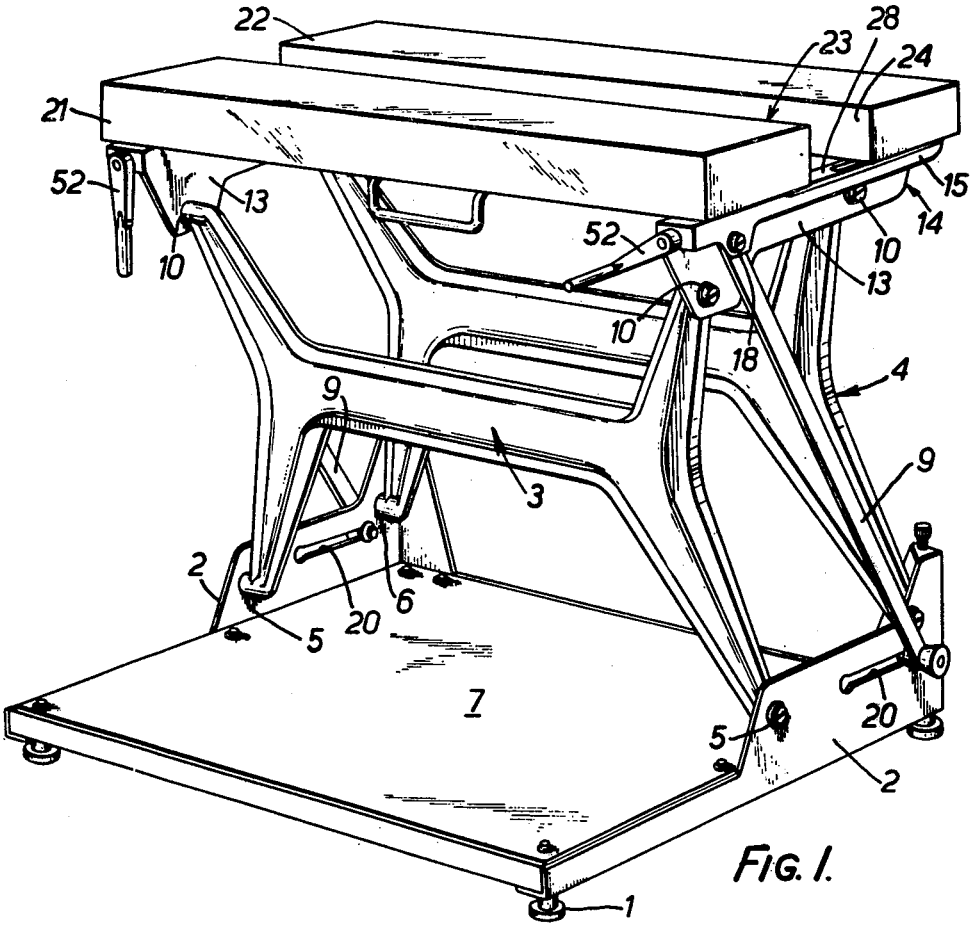
FIG. 1 is a perspective view of one form of collapsible workbench constructed in accordance with the present invention.
Figure 6:
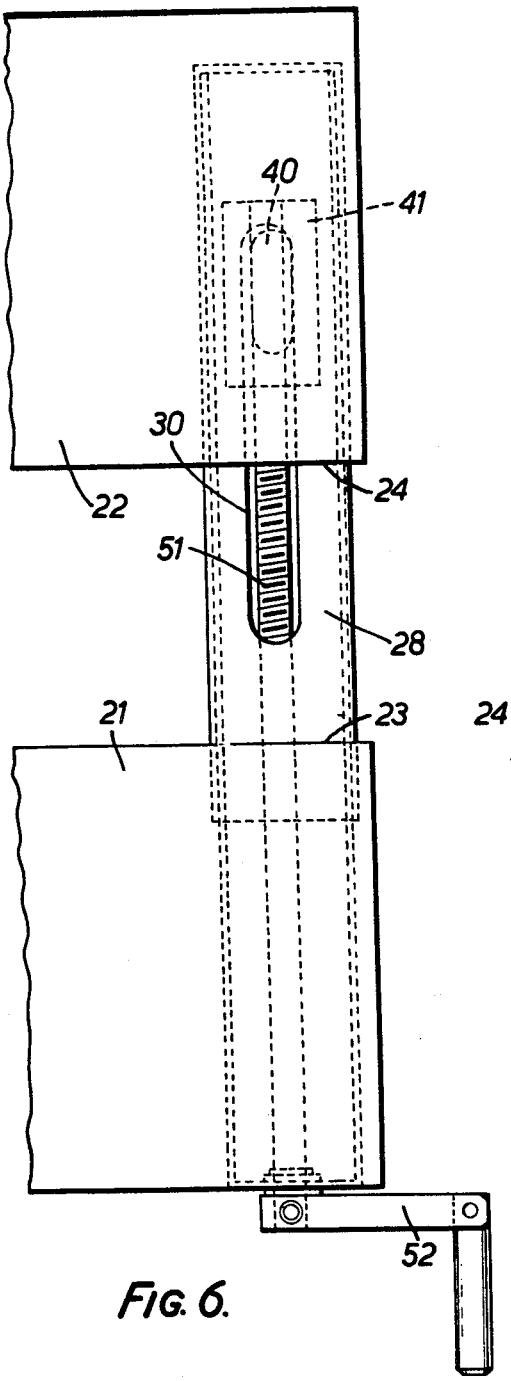
Figure 7:
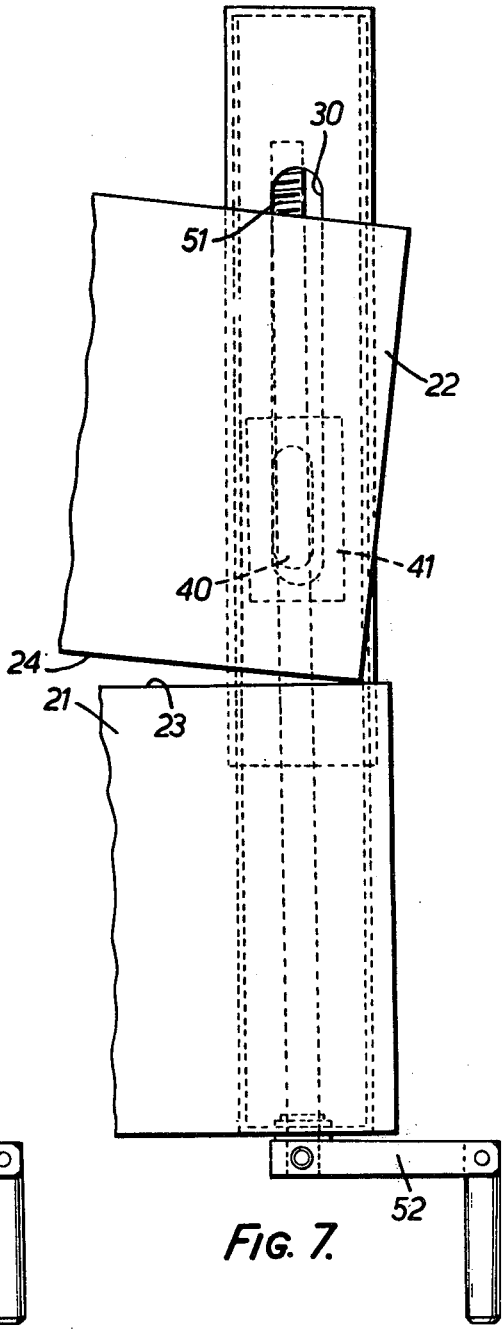

FIG. 6 shows certain parts of the workbench in plan with the pair of top members of the bench in parallel spaced relationship, and FIG. 7 is a scrap plan view showing one end of the workbench with one of the top members drawn into contact with the other top member at one end only, FIG. 1 shows the general construction of a workbench having a base structure incorporating a base board 7 mounted on adjustable feet 1 and provided at each end with a supporting bracket 2 by which a pair of generally 'H' shaped frames 3 and 4 are pivotally mounted at 5 and 6 respectively for movement between the working position of FIG. 1 and a collapsed storage position in which the top members are in close juxtaposition to the base board.

Figure 3:
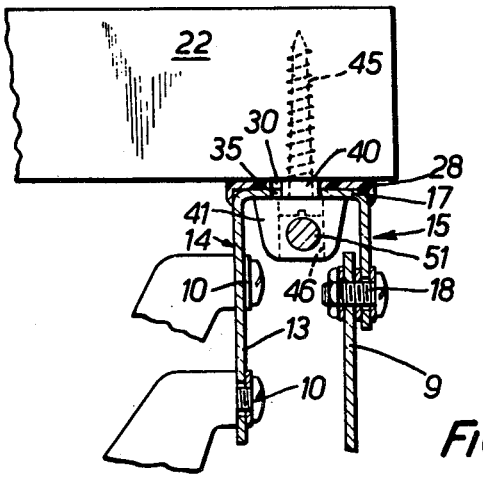
FIG. 3 is a front part-sectional elevation of the workbench of FIGS. 1 and 2.
Figure 2:
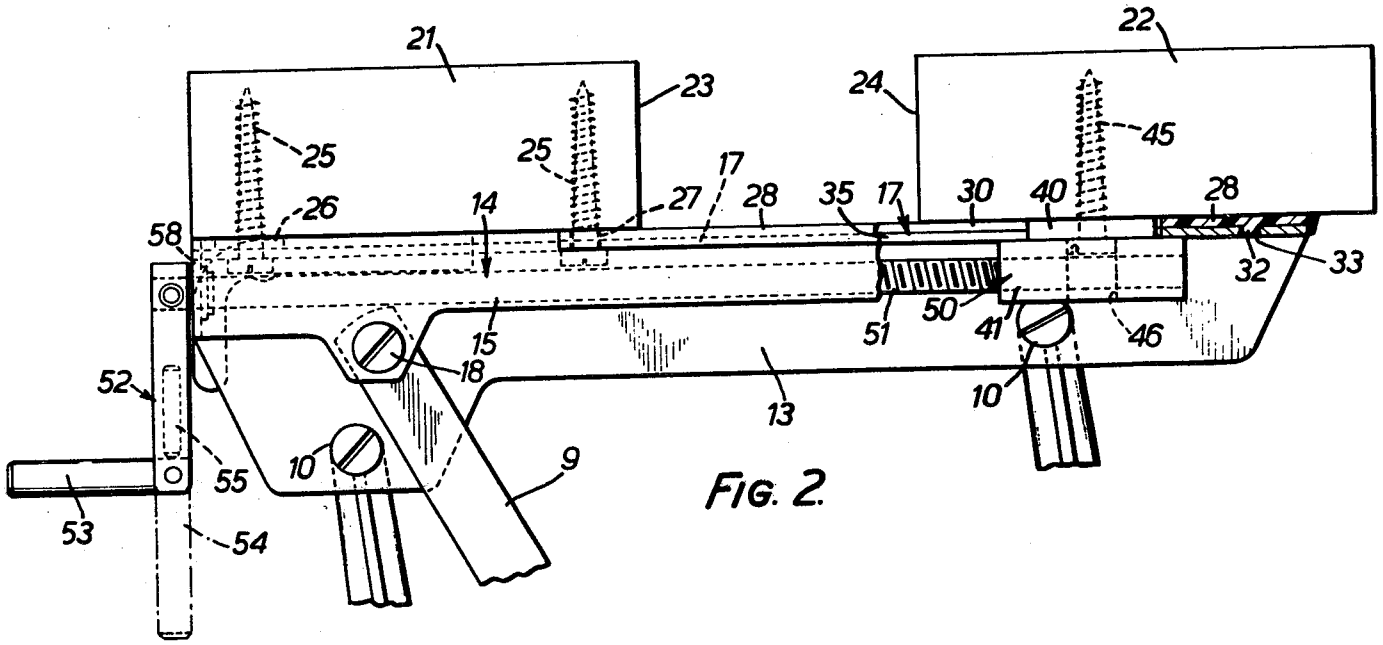
FIG. 2 is an end elevation, partly in section, of the upper end of the workbench showing the manner in which the top members act as a vice.

The upper ends of the frames 3 and 4 each afford a pair of spaced limbs which are pivoted at 10 to a vertical web 13 of a generally U-shaped inverted channel 14 the detailed form of which is shown in FIGS. 2 and 3. Thus, referring to FIG. 3 the channel 14 also includes a vertical web 15 situated externally of the web 13, the two webs 13 and 15 being interconnected by a further horizontal web 17. The diagonal bars 9 are secured to the webs 15 at pivot points 18 at their upper ends and at their lower ends co-operate with slots 20 to allow for collapsing of the workbench.

Figure 5:
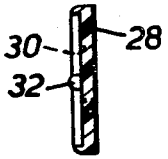
FIG. 5 is a cross-section of the slideway on the line T—T of FIG. 4.
Figure 4:
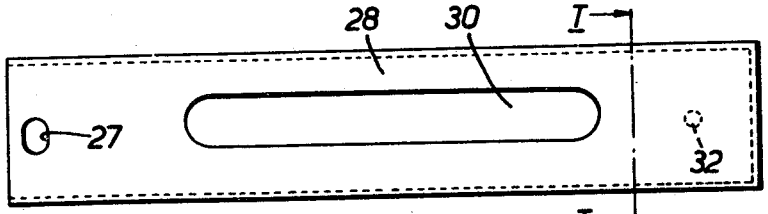
FIG. 4 is a plan view of a slideway incorporated in the workbench.

The work surface of the workbench is afforded by a pair of spaced rectangular-section timber beams 21 and 22 having their horizontal surfaces aligned in the same plane. The beams also have opposed vertical clamping faces or surfaces 23 and 24, respectively, both of which extend vertically less than one half the front-to-back dimension of the upper horizontal surfaces, as shown in FIG. 2. The clamping faces 23 and 24 as will be described, can be drawn towards one another from their spaced apart positions of FIGS. 1, 2 and 6. As shown in FIGS. 3 and 6, the ends of the beams or vise members 21 and 22 overhang the channels or support members 14 to provide a gap between the vise members at the lateral ends thereof which is clear of underlying structure. At each end the front beam 21 is rigidly connected to the horizontal web 17 of the respective channel by means of a pair of screws 25 as shown in FIG. 2, the front screw having a spacer washer 26 surrounding it between the beam and the web 17, and the rear screw 25 passing through a hole 27 in a slideway 28 formed for example of nylon or metal strip provided with a PTFE upper surface. The form of slideway is shown in detail in FIGS. 4 and 5. Apart from the hole 27 for the rear screw 25, it has a longitudinal slot 30 for a purpose to be described, and at its rear end is provided with a poppet stud 32 which, as shown in FIG. 2, is received in an aperture 33 in the horizontal web 17 of the channel 14.

The horizontal web 17 is provided with a longitudinal slot 35 of a shape corresponding to the slot 30 in the slideway and the two slots 30 and 35 have extending upwardly through them a projecting portion 40 formed on a slider member 41 shown in FIGS. 2 and 3. The upper surface of the projection 40 abuts the underside of an end of the rear beam 22 and the slider member 41 is secured to the beam 22 at each end by a single screw 45, for which purpose the underside of the slider member 41 is provided with an open recess 46, as shown in FIG. 3.

As shown in FIG. 3 the slider member 41, below the web 17, is substantially wider than the width of the slots 30 and 35 so that the rear beam 22 whilst it can ride freely in a horizontal manner along the slideway, is prevented from moving bodily upward or of tilting upwards, e.g. adjacent its front edge. It is to be noted from FIG. 3 that the width of the projection 40 of the slider member 41 is less than the width of the slots 30 and 35 to allow for lateral movement of the slider member in a manner to be described. For this purpose also the width of the lower, wider part of the slider member 41 is less than the width of the space between the webs of the channel 14.

As shown in FIG. 2, on each side of the recess 46 the slider member 41 has a screw threaded bore 50 which co-operates with an externally screw threaded device such as the rod 51, the outer end of which, to the left in FIG. 2, carries a crank handle 52 provided with a hinged end section 53 which can be maintained either in the position shown in FIG. 2 for operating purposes or hinged downwards to the dotted line position 54 against the action of a spring biassed plunger 55 when not in use. In order to support the end of the rod 51 adjacent its handle 52 the webs 13 and 15 of the channel 14 are interconnected at the front by a transverse wall 58 through which the rod 51 passes, washers being provided on each side of the wall 58 and the rod being held in position by means of a circlip.

Accordingly, rotation of the rod 51 by means of its cranked handled 52 will cause horizontal movement of the slider member 41 towards or away from the front beam 21. The extent of movement of the slider member 41 is determined in one direction by abutment of the beams 21 and 22 against one another or in the case of rearward movement of the beam 22 by abutment of the projection 40 of the slider member 41 against the rear end of the slots 30 and 35. As shown in FIG. 1 the beams 21 and 22 can be drawn together or moved apart by simultaneous or independent operation of identical screw threaded rods at each end by means of a pair of crank handles 52. In this way, therefore, the beams 21 and 22, apart from providing substantially horizontal surfaces, which together provide a working top surface upon which many operations can be carried out, also act in the manner of a vice between which lengths of timber or other material can be clamped.

Assuming that the beams 21 and 22 are initially in spaced parallel relationship as shown for example in FIGS. 1 and 2 equal rotation of the crank handles at each end will cause the beams to be maintained in parallel relationship but it is a particular feature of this workbench that one or other of the handles 52 can be operated quite independently of the other to the maximum limits allowed by movement of the respective slider members 41. In other words one end of the rear beam 22 may be fully separated from the front beam 21 and remain so whilst the other end of the rear beam 22 is drawn up fully into contact with the front beam 21. This extreme position is shown in FIG. 7. It will be appreciated that during such independent movement of only one end of the beam 22, the beam will pivot at each end about the screws 45 by which it is secured to the two slider members 41. Assuming the extreme example mentioned above where one of the ends of the beam remains stationary, full clamping up for example of the right-hand end of the beam 22, with no movement of the left-hand end, in the manner shown in FIG. 7, will of necessity require the slider member 41 on the right to move to the left due to the arcuate movement of the right-hand end of the rear beam 22. Such sideways movement of the slider member 41 is accommodated by the excess width of the slots 30 and 35 in relation to the width of the projection 40 of the slider member 41 as shown and described with respect to FIG. 3. FIGS. 6 and 7 demonstrate this lateral movement of the slider member 41 between its extreme positions. Thus in FIG. 6 the outline of the projection 40 of the slider member 41 is shown as engaging the right-hand face of the elongated slot 30 in the slideway 28. After full clamping up to the position shown in FIG. 7 the projection 40 of the slider member 41 moves laterally to engage the lefthand side of the slot 30. Of necessity in this arrangement the slider member 41 has to tilt slightly with respect to the longitudinal axis of the slot 30 in the clamped up position of FIG. 7. This will cause slight lateral movement of the rear end of the screw threaded rod 51 as shown in FIG. 7 but this can be readily accommodated by means of the tolerances in the manner of mounting of the rod 51 at its front end.

It will be appreciated that the relative dispositions of the parts in FIGS. 6 and 7 show an extreme condition in which a full 3" closure of the beams has occurred at one end. In most instances such an extreme condition will not be required and there will usually be some clamping up at both ends either to the same or a different extent. The manner in which the slider members 41 are mounted to permit this independent movement avoids any difficulty of seizure of one or other of the screw threaded rods during clamping up or release as would normally be expected to occur with spaced screw threaded members of this type. Normally with spaced screw threaded members it is necessary to maintain substantially equal rotation of each in order to prevent seizure. The use of a pair of spaced screw threads of which one can be in tension thus applying a compressional load on a part clamped between the vertical faces, and the other can, if desired, take a reaction load in compression, is particularly useful for the clamping up of short parts. This is especially so where the point of grip of the part is outboard of one of the screw threads.

Accordingly, the workbench according to the invention enables a part to be clamped up within the space between the two beams irrespective of whether its side faces are parallel or inclined to one another. Also, as is apparent from FIGS. 1 and 2, the location of the channels 14 and associated screw threaded rods 50 adjacent the ends of the beams 21 and 22 result in the central region underlying the beams between the respective channels and rods being free of structure, thereby enabling a workpiece to be inserted between the beams in the center region thereof to a depth greater than the vertical depth of the faces 23 and 24.

Whilst with the embodiment of FIGS. 1 to 7 the screw threaded rods 51 are used in tension for clamping up, this is not essential and compression screws could be used.

Whilst the twin screws have been described as being entirely independently operable it is envisaged that it may be possible to provide an optional link between them when it is desired that they should maintain the pair of top members in constant alignment. Equally it is envisaged that each screw may be provided with a quick release in order that the members can be drawn together or moved apart separately for coarse adjustment prior to clamping up.

What I claim as my invention and desire to secure by Letters Patent is:

1. A portable, collapsible workbench adapted to be carried by hand to a site of use by an individual and there erected in a free-standing manner, comprising:

bench top means defining a substantially planar, generally rectangular working surface, said bench top means including front and rear, laterally elongated vise members, the upper surfaces of which are substantially co-planar and form said working surface and laterally elongated edges of which are arranged in side-by-side facing relation to provide workpiece clamping surfaces extending over the full lateral extent of said vise members, the dimension of each vise member in the lateral direction being substantially greater than in the front-to-rear direction and the dimension of the facing edge of each vise member in the direction normal to said working surface being less than said front-to-rear dimension, whereby said vise members constitute rigid beams for clamping workpieces therebetween;

means supporting said vise members for front-to-rear movement relative to one another in the plane of the working surface while constraining said vise members against any substantial movement out of said plane;

a pair of laterally spaced-apart, hand-operable devices operatively coupled between said front and rear vise members for moving said vise members relative to one another in the front-to-rear direction to enable a workpiece to be clamped between said clamping surfaces;

said supporting means and said hand-operable devices underlying said vise members such that the full area of each of said clamping surfaces is unobstructed and available for clamping a workpiece; and collapsible leg means, including at least two leg frames pivotally connected to said bench top supporting means, for folding between an erected condition, in which said leg frames are spread apart and support said bench top working surface at a convenient working height above the floor, and a folded condition, in which bench top supporting means is juxtaposed to said leg means and said leg frames are folded compactly together.

2. The workbench of claim 1 wherein said supporting means and said hand-operable devices comprise front-to-back extending members located adjacent the lateral ends of said vise members such that the region underlying the vise members between said front-to-back extending members is free to receive a workpiece to a depth below the clamping surfaces of said vise members.

3. The workbench of claim 2 wherein the ends of said vise members extend laterally beyond said front-to-back extending members so as to permit a workpiece to be clamped between said vise members laterally outside of said supporting means and said hand-operable devices.

4. The workbench of claim 1 wherein the front-to-back dimensions of said front and rear vise members are such that the upper surfaces of said vise members occupy the major portion of the area of said bench top working surface even when said hand-operable devices are operated to move said vise members apart by the maximum spacing.

5. The workbench of claim 1 wherein the front-to-back dimension of the upper surface of each vise member is less than one-fourth the dimension of said vise member in the lateral direction, and said front-to-back upper surface dimension is at least twice as great as the dimension is at least twice as great as the dimension of the elongate facing edge of said vise member in the direction normal to said working surface.

6. A portable, collapsible workbench adapted to be carried by hand to a site of use by an individual and there erected in a free-standing manner, comprising:

two vise members, each having (a) a laterally elongated clamping face whose length is substantially greater than its vertical height and (b) a top working surface above said clamping face whose front-to-back depth is greater than said vertical height of the clamping face;

a supporting structure including two transversely extending support members having upper surfaces defining a plane of support;

one of said vise members being rigidly attached to said supporting structure and the other vise member being slidably supported from directly below by the supporting structure;

two screw threaded rods extending transversely beneath said vise members, each rod being axially fixed at its front end to the supporting structure and free at its rear end;

two internally threaded connections attached to the underside of said other vise member below the clamping faces and threadedly engaged, one each, to said screw threaded rods, so that rotating said rods about their axes positively moves said other vise member toward and away from said one vise member;

guide means extending between said supporting structure and said moving vise member for (a) holding said other vise member against substantial upward movement away from said supporting structure, (b) limiting lateral movement of said other vise member relative to said supporting structure, and (c) preventing substantially all tilting of said other vise member relative to said supporting structure out of said plane of support;

said vise members overhanging said supporting structure at both lateral ends and defining therebetween a gap which is open at both ends and clear of underlying structure, whereby a door or the like may be laid in said gap edge down on the floor and gripped between said overhanging end portions of said vise members; and two leg frames pivotally connected to said supporting structure for pivoting between a spaced-apart position, wherein they support said vise members horizontally at a convenient working height above the floor in an erect configuration of said workbench, and a folded position, wherein they lie juxtaposed to said supporting structure for convenient storage of said workbench in a small space.

7. The workbench of claim 6, wherein:

said screw threaded rods lie below said plane of support; and said leg frames in the erect configuration of said workbench are substantially clear of the vertical space lying below the gap between said vise members and between said screw rods.

8. A portable, collapsible workbench adapted to be carried by hand to a site of use by an individual and there erected as a rigid, free-standing structure, comprising:

bench top mean defining a substantially planar, generally rectangular working surface, said bench top means including front and rear, laterally elongated vise members, the upper surfaces of which are substantially co-planar and together form said working surface and laterally elongated edges of which are arranged in side-by-side facing relation to provide workpiece clamping surfaces extending over the full laterl extent of said vise members;

a pair of generally elongated, front-to-back extending support members underlying said front and rear vise members adjacent to, but laterally inward of, each end thereof;

means carried by said support members and at least one of said front and rear vise members for supporting said vise members for front-to-rear movement relative to one another in the plane of the working surface and for constraining said vise members against any substantial movement out of said plane; a hand-operable, screw-threaded device carried by each of said support members in underlying relation thereto and operatively coupled between said front and rear vise members for moving said vise members relative to one another in the front-to-rear direction to enable a workpiece to be clamped between said clamping surfaces, said devices being operable to move said front and rear vise members relatively apart and together between a position of maximum separation, in which the clamping surfaces of said vise members are separated by a lateral gap, and a closed position, in which said clamping surfaces are substantially in contact; and collapsible leg means, including front and rear leg frames pivotally connected to said support members, for folding between an erect condition, in which said leg frames are spread apart and support said bench top working surface at a convenient working height above the floor, and a collapsed condition, in which support members are juxtaposed to said leg means and said leg frames are folded compactly together, said rear leg frame in said erect condition being located wholly to the rear of the maximum rearward position of the clamping surface of said rear vise member and said front leg frame in said erect condition being located wholly in front of the maximum forward position of the clamping surface of said front vise member, whereby the entire region underlying the gap between said vise members and extending laterally between said supporting members is free of structure so as to permit a workpiece to be inserted into said region to a depth below the clamping surfaces of said vise members.

* * * * *

UNITED STATES PATENT OFFICE

CERTIFICATE OF CORRECTION

Patent No. 4,140,309 Dated February 20, 1979

Inventor(s) Ronald P. Hickman

It is certified that error appears in the above-identified patent and that said Letters Patent are hereby corrected as shown below:

First page, Item [60], last line, "3,615,807" should read --3,615,087--;
Col. 1, line 8, "3,891,619" should read --3,841,619--;
Col. 1, line 10, "3,615,887" should read --3,615,087--;
Col. 3, last line, "handled" should read --handle--;
Col. 6, line 42, delete "is at least twice as great as the dimension";
Col. 7, line 42, "mean" should read --means--;
Col. 8, line 2, "laterl" should read --lateral--;
Col. 8, line 13, "a hand-operable ..." should start a new line, out to the left margin.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*